US008408680B2

(12) United States Patent
Liao et al.

(10) Patent No.: US 8,408,680 B2
(45) Date of Patent: Apr. 2, 2013

(54) INK-JET CHIP

(75) Inventors: Wen Hsiung Liao, Hsin-Chu (TW); Rong Ho Yu, Hsin-Chu (TW); Cheng Ming Chang, Hsin-Chu (TW); Hsien Chung Tai, Hsin-Chu (TW)

(73) Assignee: Microjet Technology Co., Ltd., Hsin-chu (TW)

( * ) Notice: Subject to any disclaimer, the term of this patent is extended or adjusted under 35 U.S.C. 154(b) by 0 days.

(21) Appl. No.: 13/226,943

(22) Filed: Sep. 7, 2011

(65) Prior Publication Data

US 2012/0081471 A1 Apr. 5, 2012

(30) Foreign Application Priority Data

Sep. 30, 2010 (CN) ..... 2010 1 0503669

(51) Int. Cl.
*B41J 2/05* (2006.01)
*B41J 29/38* (2006.01)

(52) U.S. Cl. ..... 347/57; 347/9

(58) Field of Classification Search ..... None
See application file for complete search history.

(56) References Cited

U.S. PATENT DOCUMENTS 5,621,440 A * 4/1997 Takahashi ..... 347/12

* cited by examiner

*Primary Examiner* — Geoffrey Mruk
(74) *Attorney, Agent, or Firm* — Muncy, Geissler, Olds & Lowe, PLLC

(57) ABSTRACT

The present invention relates to an ink-jet chip, adaptive for a printing device, at least comprising: a plurality of ink-jet heating elements and an ink-jet signal generating circuit. The ink-jet signal generating circuit at least includes: a counter electrically connected with the printing device, for receiving a counter control signal and a pulse signal, and generating a plurality of counter signals corresponding to the counter control signal and the pulse signal; and a decoder electrically connected with the counter, for receiving and decoding the plurality of counter signals, for generating a plurality of address signals, and selecting a corresponding ink-jet heating element basing on the plurality of address signals.

5 Claims, 6 Drawing Sheets

INK-JET CHIP

This application claims the benefits of the China Patent Application Serial Number 201010503669.4, filed on Sep. 30, 2010, the subject matter of which is incorporated herein by reference.

BACKGROUND OF THE INVENTION

1. Field of the Invention

The present invention relates to a chip, especially to an ink jet chip.

2. Description of Related Art

With the penetration of the personal computer and the continuous development of the industrial technology, printing device has been the indispensable product for industry use, or for the periphery of the personal computer in a family. The use's requirement on the efficiency, functionality and precision of the printing device has also been gradually increased. They hope the printing device can provide both high quality and high-speed printing, while having a minimum total volume at the same time.

For providing multi-color printing, a plurality of ink cartridges must be installed on the carriage of a conventional printing device. As a result, the lateral volume of the carriage must be increased with the volume of the plurality of ink cartridges. Moreover, the moving distance of the carriage in the printing device is elongated, while the receiving space at the interior of the printing device is also raised. Both of them are opposite to the miniaturizing trend of the nowadays-electronic device.

In addition, for raising the printing speed and the printing quality, an ink-jet element must be installed on the ink-jet head of a conventional ink cartridge. Please refer to FIG. 1, which is a perspective view of circuit of a conventional ink-jet element. As shown in the figure, the conventional ink-jet element 1 makes use of the characteristic of both the resistor 11 and the MOSFET 12, for controlling the ink-jet operation of the ink-jet head. However, since in the conventional printing device, a single control contact 13 can only control signal ink-jet element 1, the number of control contacts must be increased, if the number of ink-jet elements is going to be increased. As a result, the receiving space of the ink-jet chip should increase accordingly. Of course, the volume of the ink cartridge is inevitably increased significantly. Therefore, the contradiction between the printing quality and the size miniaturizing of the printing device is existed. Moreover, the increasing number of ink-jet elements also increases the manufacturing cost, and makes the interference between wires easily to be happened. Therefore, the efficiency of the conventional printing device is lowered, resulting in the longer printing time and the raising of the time cost of the user thereof.

Therefore, it is desirable to provide an improved ink-jet chip to mitigate and/or obviate the aforementioned drawbacks, which is also capable of controlling the largest number of ink-jet elements with the lowest number of control contacts, for reducing the manufacturing cost and the volume of the ink-jet chip.

SUMMARY OF THE INVENTION

The main object of the present invention to provide an ink-jet chip, capable of obviating the drawbacks that the volume of the conventional ink-jet chip enlarges along with the increasing in the number of the control contacts thereof, resulting in the increasing of the volume of an ink-jet cartridge, the raising of the manufacturing cost of thereof, and the interference between the different wires thereof.

The other object of the present invention to provide an ink jet chip, capable of controlling the largest number of ink-jet elements with the lowest number of control contacts, for reducing the manufacturing cost and the volume of the ink-jet chip, and further reducing the volume of the ink-jet cartridge.

To achieve the object, in a broader type of the present invention, an ink-jet chip is provided, adaptive for a printing device, at least comprising: a plurality of ink-jet heating elements; and an ink-jet signal generating circuit. The ink-jet signal generating circuit at least includes: a counter electrically connected with the printing device, for receiving a counter control signal and a pulse signal outputted from the printing device, and generating a plurality of counter signals corresponding to the counter control signal and the pulse signal; and a decoder electrically connected with the counter, for receiving and decoding the plurality of counter signals, for generating a plurality of address signals, and selecting a corresponding ink-jet heating element basing on the plurality of address signals.

DETAILED DESCRIPTION OF THE PREFERRED EMBODIMENT

Figure 1:
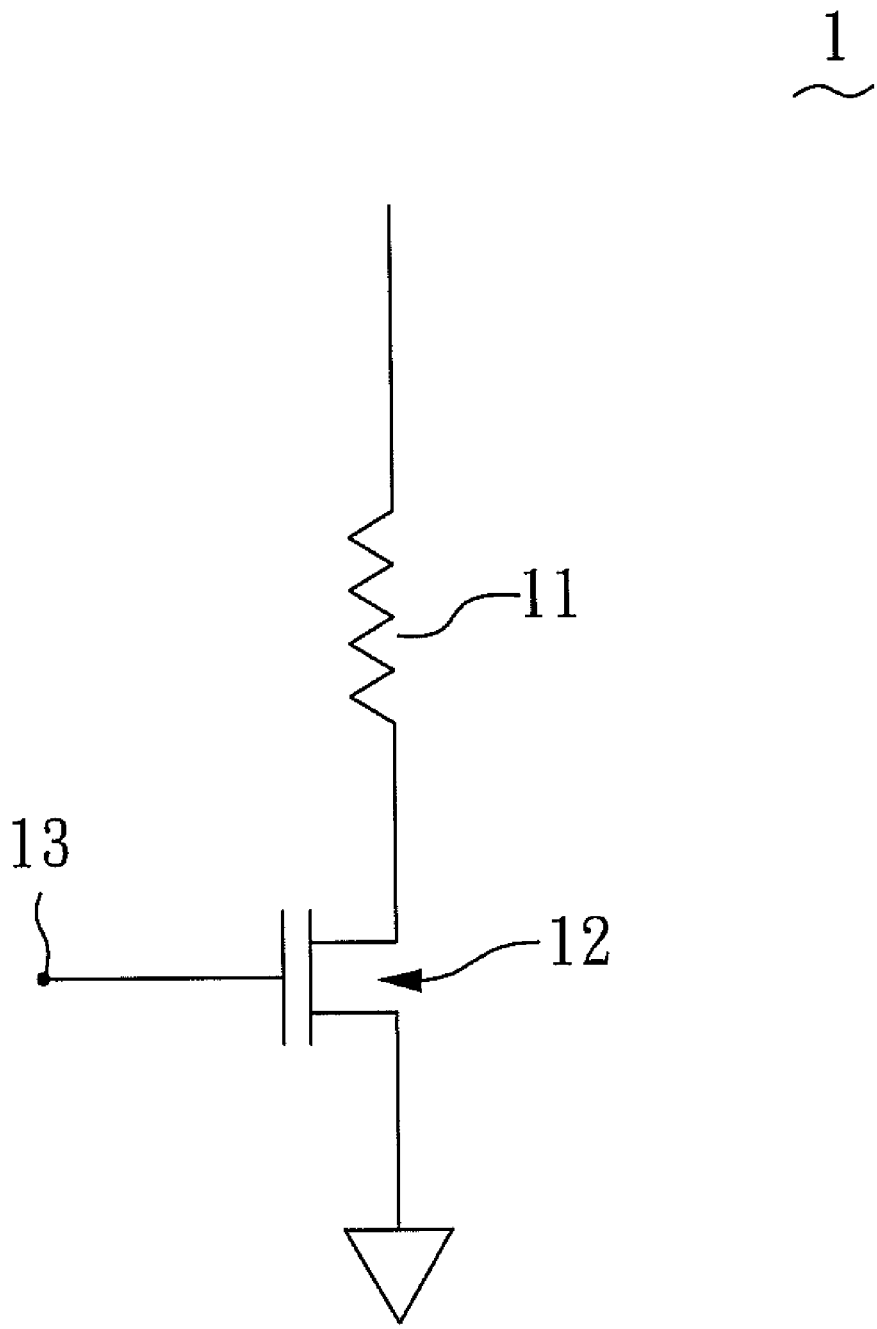
FIG. 1 (PRIOR ART)
FIG. 1 is a perspective view of circuit of a conventional ink-jet element.

Other objects, advantages, and novel features of the invention will become more apparent from the following detailed description when taken in conjunction with the accompanying drawings. The description and the drawing in the specification of the present invention are essentially used for explanation only; they are not supposed to be used for limiting the scope of the present invention.

Figure 2:
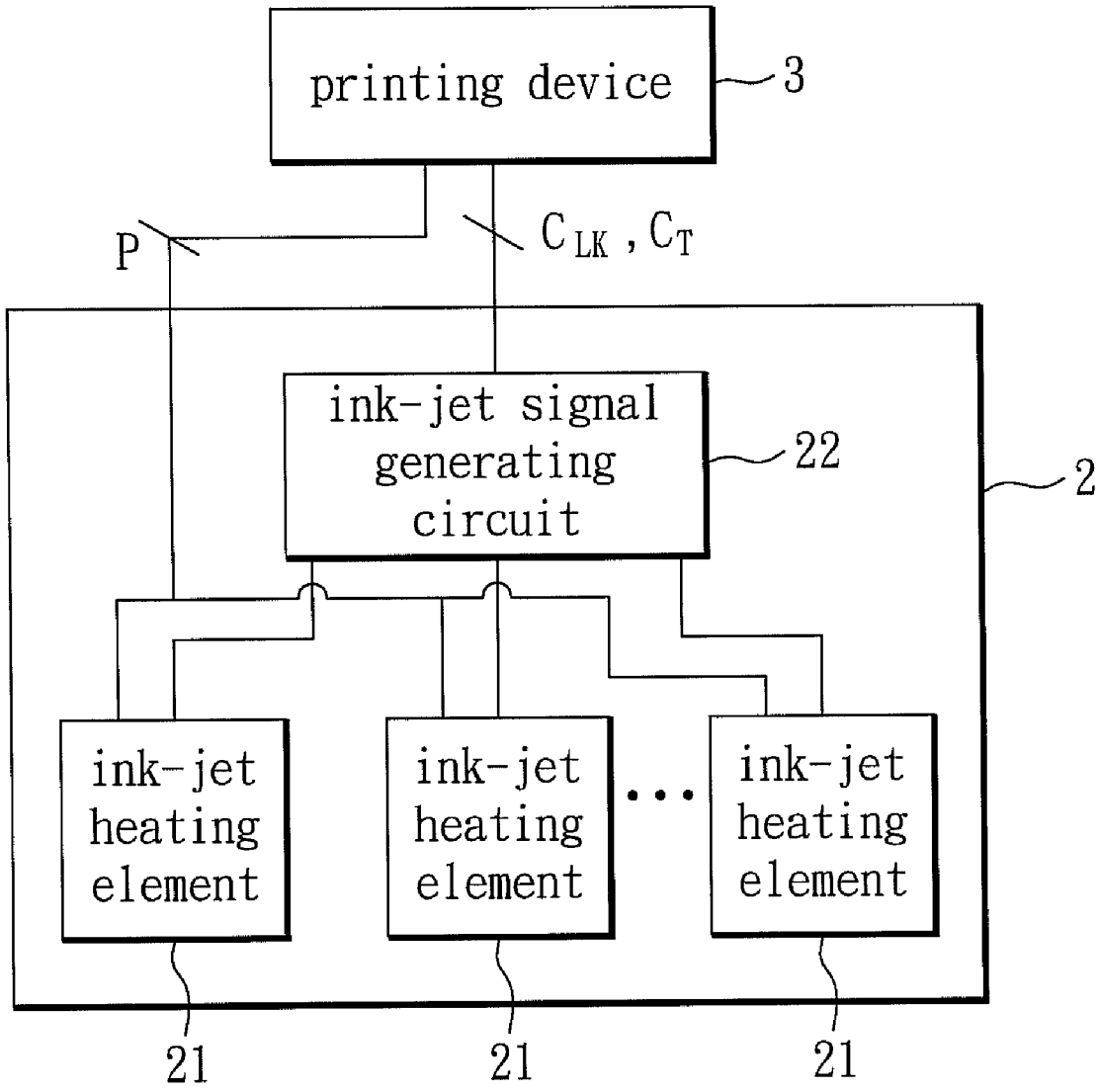
FIG. 2 is a perspective view of circuit block of the ink-jet chip and the printing device according to one preferred embodiment of the present invention.
Figure 3:
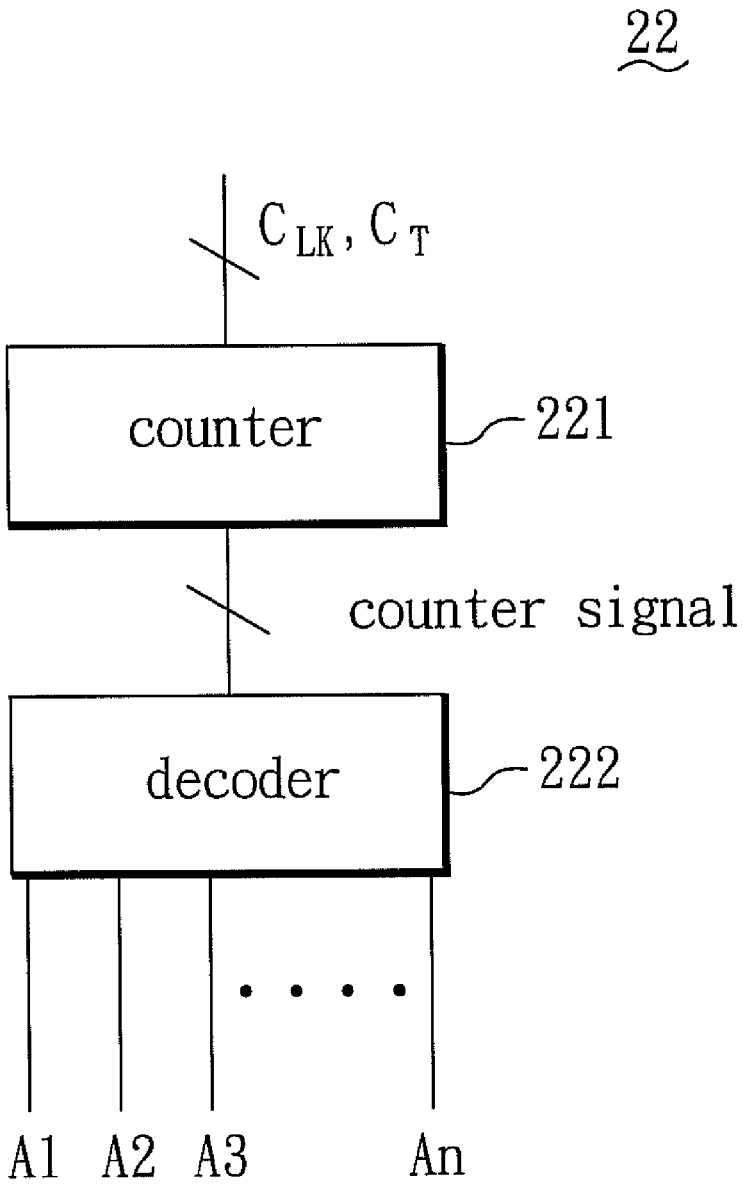
FIG. 3 is a perspective view of circuit block of the ink jet signal generating circuit shown in FIG. 2.

Please refer to FIG. 2 and FIG. 3, which are the perspective view of circuit block of the ink-jet chip and the printing device according to one preferred embodiment of the present invention, and the perspective view of circuit block of the ink-jet signal generating circuit shown in FIG. 2. In the present embodiment, an ink-jet chip 2 is adaptive for a printing device 3, at least comprises: a plurality of ink-jet heating elements 21, and an ink-jet signal generating circuit 22 including a counter 221 and a decoder 222. Wherein, the ink-jet heating element 21 is electrically connected with the printing device 3, for receiving an image data P outputted from the printing device 3. The printing device 3 could be a printer body, and the ink-jet chip 2 could be installed on an ink-jet head of a printing cartridge.

Besides, the counter 221 could be electrically connected with the printing device 3, for receiving a counter control signal $C_T$ and a pulse signal $C_{LK}$ outputted from the printing device 3, and generating a plurality of counter signals corresponding to the counter control signal $C_T$ and the pulse signal $C_{LK}$. The decoder 222 could be electrically connected with the counter 221, for receiving and decoding the plurality of counter signals, for generating a plurality of address signals $A_1$-$A_n$, and selecting a corresponding ink-jet heating element 21 basing on the plurality of address signals $A_1$-$A_n$. Once the corresponding ink-jet heating element 21 is selected, the execution or the not-execution of a printing job is determined according to the image data P.

Please refer to FIG. 3 again, in some embodiments of the present invention, the counter 221 could comprise, but not limited to, JK flip-flop, D flip-flop, T flip-flop, RS flip-flop, or the group consisting thereof. In some embodiments of the present invention, the counter 221 could further comprise AND gate, OR gate, NOT gate, NAND gate, NOR gate, XOR gate, XNOR gate, or the group consisting thereof. Wherein, the counter 221 has both the functions of counting up and counting down, while the counter 221 counting increasingly in the function of counting up and decreasingly in the function of counting down, but the operation of the counter 221 is not limited to these functions. However, the switching between these functions, i.e. counting up and counting down, is determined with the enable status or the disable status of the counter control signal.

Figure 4:
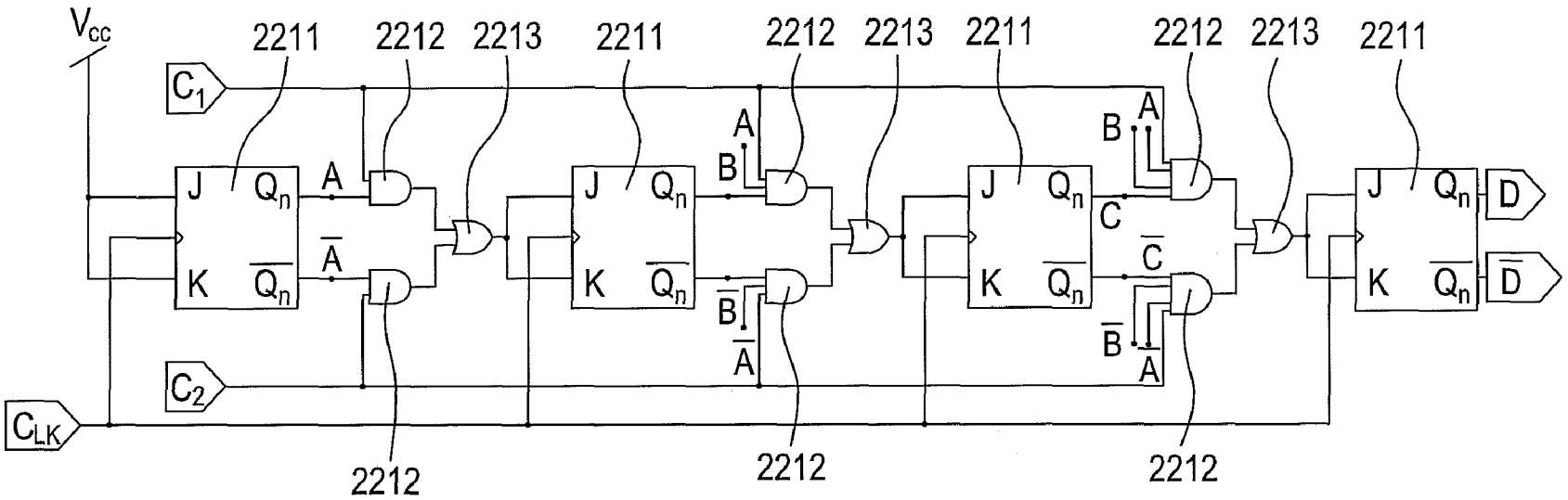
FIG. 4 is a perspective view of circuit block of the counter shown in FIG. 3.

Please refer to FIG. 4, which is a perspective view of circuit block of the counter shown in FIG. 3. In the present embodiment, the composition element of the counter 221 could include, but not limited to, JK flip-flop 2211, AND gate 2212, and OR gate 2213, etc. In addition, in the present embodiment, the counter control signal $C_T$ comprises a first counter control signal $C_1$ and a second counter control signal $C_2$. The counter 221 switches to the function of counting up when the first counter control signal $C_1$ is in an enable status and the second counter control signal $C_2$ is in a disable status. Besides, the counter 221 switches to the function of counting down when the first counter control signal $C_1$ is in a disable status and the second counter control signal $C_2$ is in an enable status. In the present embodiment, the enable status indicates a high voltage, while the disable status indicates a low voltage, but the indication between the status and the voltage of a signal is not thus limited. As shown in FIG. 4, the counter 221 could receive the first counter control signal $C_1$, the second counter control signal $C_2$, and the pulse signal $C_{LK}$ from the printing device 3, and generate a plurality of counter signals A, B, C, D, $\overline{A}$, $\overline{B}$, $\overline{C}$, and $\overline{D}$. The counter 221 transmits these counter signals A, B, C, D, $\overline{A}$, $\overline{B}$, $\overline{C}$, and $\overline{D}$ to the decoder 222 for decoding. Wherein, due to the characteristic of the JK flip-flop 2211, either one of the counter signal A or the counter signal $\overline{A}$ is in the enable status, while the other one is in the disable status. In same manner, either one of the counter signal B or the counter signal $\overline{B}$ is in the enable status, while the other one is in the disable status. Besides, either one of the counter signal C or the counter signal $\overline{C}$ is in the enable status, while the other one is in the disable status. In addition, either one of the counter signal D or the counter signal $\overline{D}$ is in the enable status, while the other one is in the disable status.

Wherein, the decoder 222 could comprise AND gate, OR gate, NOT gate, NAND gate, NOR gate, XOR gate, XNOR gate, or the group consisting thereof.

Figure 5:
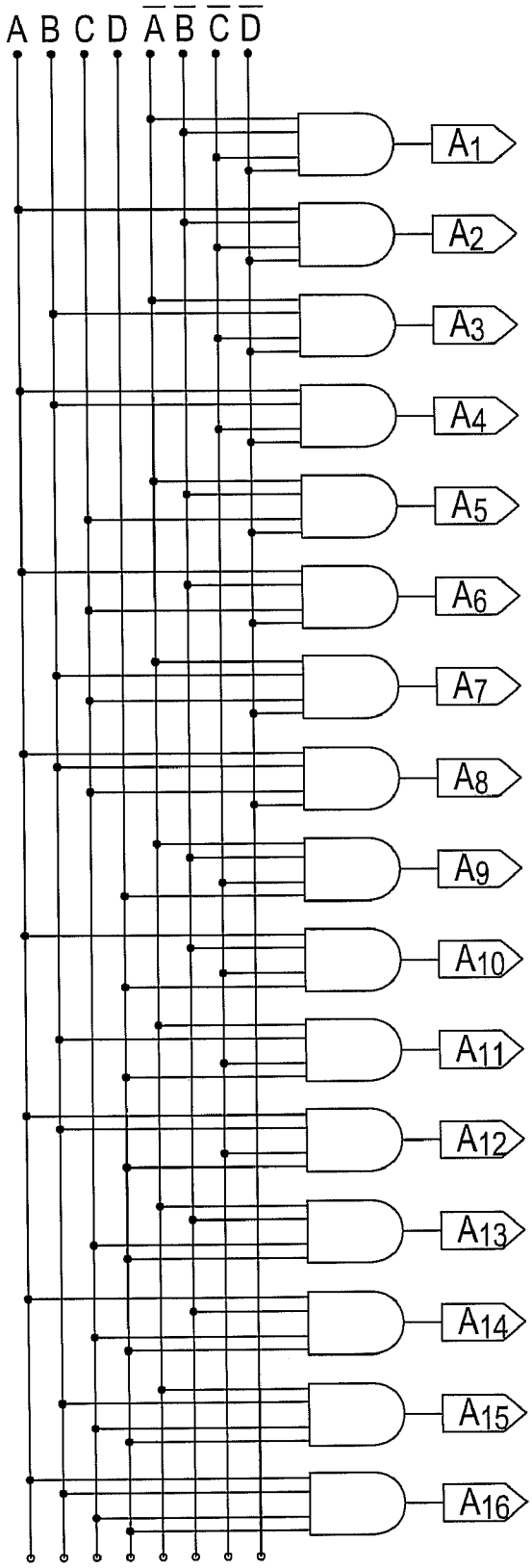
FIG. 5 is a perspective view of circuit block of the decoder shown in FIG. 3.

Please refer to FIG. 5, which is a perspective view of circuit block of the decoder shown in FIG. 3. The decoder 222 receives the counter signals A, B, C, D, $\overline{A}$, $\overline{B}$, $\overline{C}$, and $\overline{D}$, and decodes these counter signals for generating a plurality of address signals $A_1$-$A_n$. In the present embodiment, since the counter 221 is consisted of 4 JK flip-flops 2211 and outputs 8 counter signals A, B, C, D, $\overline{A}$, $\overline{B}$, $\overline{C}$, and $\overline{D}$ to the decoder 222, 16 address signals $A_1$-$A_{16}$ can be generated by the decoder 222 after the decoding process. The decoder 222 then selects a corresponding ink-jet heating element 21 basing on these 16 address signals $A_1$-$A_{16}$.

Figure 6:
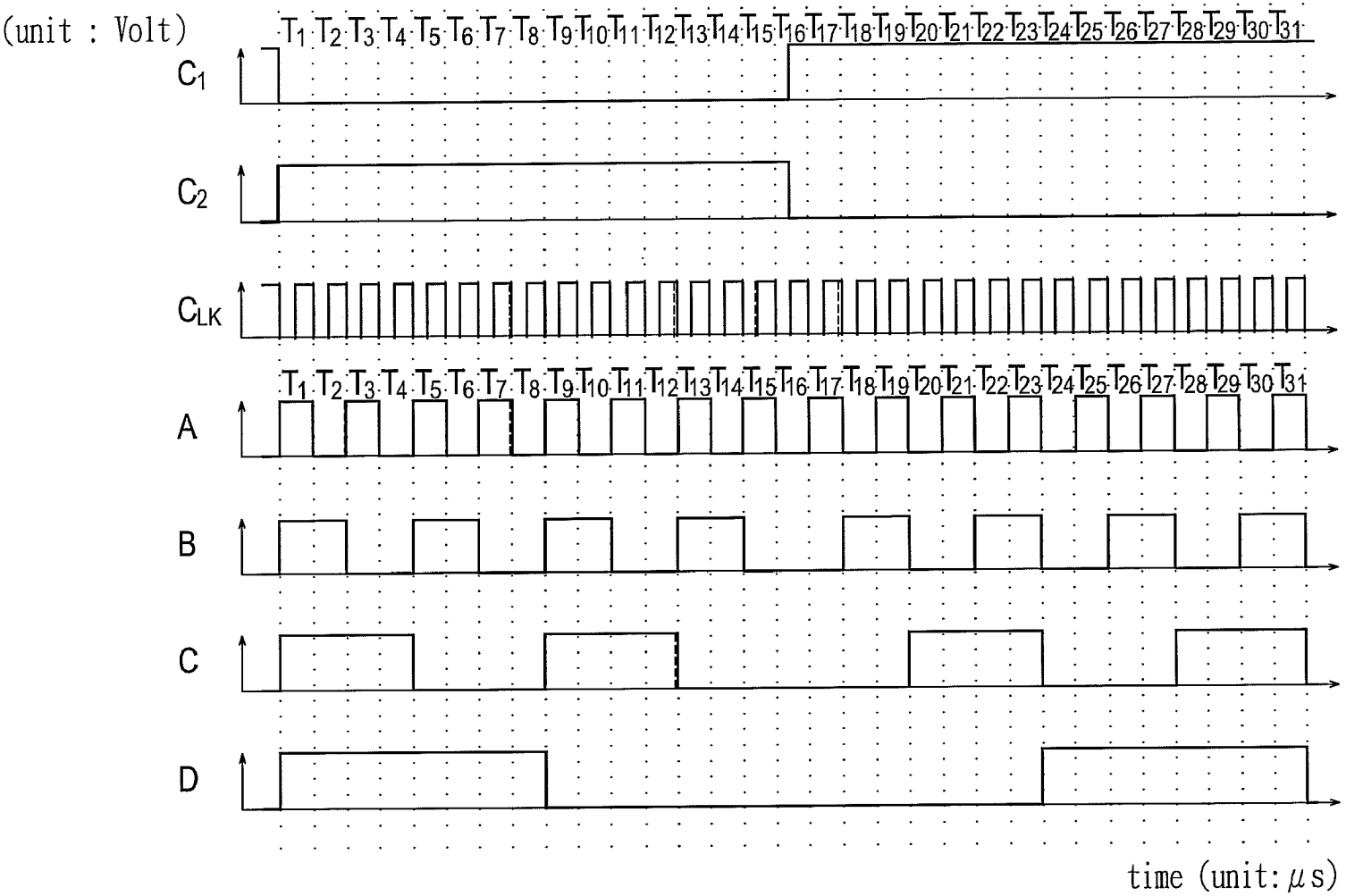
FIG. 6 is a perspective view of the signal-sequence diagram according to one preferred embodiment of the present invention.

Please refer to FIG. 6 and the below Table 1, in cooperation with the FIG. 4 and the FIG. 5. FIG. 6 is a perspective view of the signal-sequence diagram according to one preferred embodiment of the present invention. Table 1 displays the correspondence between time periods, counter signals outputted from the counter, and the address signals outputted from the decoder. In the present embodiment, the counter signal D and the counter signal A represent the maximum bit and the minimum bit in a binary system, respectively. However, the representation of these counter signals is not thus limited. As shown in FIG. 6 and listed in Table 1, when the time is in the time period $T_1$, since the first counter control signal $C_1$ is switched to the disable status and the second counter control signal $C_2$ is switched to the enable status, the counter 221 switches to the function of counting down, making the counter signals A, B, C, D to be in a enable status, respectively. That is, a binary value 1111 is formed. The decoder 222 decodes the binary value 1111 and thus outputs 16 address signals $A_1$-$A_{16}$, wherein the address signal $A_{16}$ is in an enable status, while the other address signals $A_1$-$A_{15}$ are in the disable status. The decoder 222 selects the ink-jet heating element 21 corresponding to the address signal $A_{16}$. When the time is in the time period $T_2$, since the counter 221 is still in the function of counting down, the counter 221 decreases the binary value represented by the counter signals A, B, C, D, resulting in the counter signals B, C, D being in the enable status and the counter signal A in the disable status. That is, a binary value 1110 is formed. The decoder 222 decodes the binary value 1110 and thus outputs 16 address signals $A_1$-$A_{16}$, wherein the address signal $A_{15}$ is in an enable status, while the other address signals $A_1$-$A_{14}$ and $A_{16}$ are in the disable status. The decoder 222 selects the ink-jet heating element 21 corresponding to the address signal $A_{15}$. In same manner, as listed in Table 1, when the time is in the time periods $T_3$-$T_{15}$, the decoder 222 selects the corresponding ink-jet heating element 21 corresponding to the address signal $A_{14}$-$A_7$, basing on the counter signals A, B, C, D outputted from the counter 221 and the binary value represented by the counter signals A, B, C, D.

Of course, when the time is in the time period $T_{16}$, the decoder 222 selects the corresponding ink-jet heating element 21 corresponding to the address signal $A_1$. However, at this time, the counter signals A, B, C, D are all in the disable status, making the binary value represented by them to be 0000. As a result, the first counter control signal $C_1$ is switched to the enable status and the second counter control signal $C_2$ is switched to the disable status, making the counter 221 to be switched to the function of counting up. When the time is in the time periods $T_{17}$-$T_{31}$, the counter 221 increases the binary value represented by the counter signals A, B, C, D in these time periods, respectively, making the disable/enable status of the counter signals A, B, C, D in these time periods to be the same as the disable/enable status of the counter signals A, B, C, D when the time is in the corresponding time periods $T_{15}$-$T_1$. In other words, in these time periods $T_{17}$-$T_{31}$, the binary value represented by the counter signals A, B, C, D is the same as the binary value represented by the counter signals A, B, C, D in the corresponding time periods $T_{15}$-$T_1$. Therefore, the same ink-jet heating element 21 will selected in these time periods $T_{17}$-$T_{31}$, and in the corresponding time periods $T_{15}$-$T_1$. As clearly shown in this embodiment, through the ink-jet signal generating circuit 22, the ink-jet chip 2 of the present invention can control 16 ink-jet heating elements 21, merely by electrically connecting with the 3 contacts of the printing device 3, and transmitting the first counter control signal $C_1$, the second counter control signal $C_2$, and the pulse signal $C_{CK}$ through these 3 contacts.

TABLE 1 the table displaying the correspondence between time periods, counter signals outputted from the counter, and the address signals outputted from the decoder.

| Time | Counter signals outputted from the counter | | | | Address signals outputted from the decoder |
|---|---|---|---|---|---|
| T | D | C | B | A | A |
| $T_1$ | 1 | 1 | 1 | 1 | $A_{16}=1, A_X=0$ |
| $T_2$ | 1 | 1 | 1 | 0 | $A_{15}=1, A_X=0$ |
| $T_3$ | 1 | 1 | 0 | 1 | $A_{14}=1, A_X=0$ |
| $T_4$ | 1 | 1 | 0 | 0 | $A_{13}=1, A_X=0$ |
| $T_5$ | 1 | 0 | 1 | 1 | $A_{12}=1, A_X=0$ |
| $T_6$ | 1 | 0 | 1 | 0 | $A_{11}=1, A_X=0$ |
| $T_7$ | 1 | 0 | 0 | 1 | $A_{10}=1, A_X=0$ |
| $T_8$ | 1 | 0 | 0 | 0 | $A_9=1, A_X=0$ |
| $T_9$ | 0 | 1 | 1 | 1 | $A_8=1, A_X=0$ |
| $T_{10}$ | 0 | 1 | 1 | 0 | $A_7=1, A_X=0$ |
| $T_{11}$ | 0 | 1 | 0 | 1 | $A_6=1, A_X=0$ |
| $T_{12}$ | 0 | 1 | 0 | 0 | $A_5=1, A_X=0$ |
| $T_{13}$ | 0 | 0 | 1 | 1 | $A_4=1, A_X=0$ |
| $T_{14}$ | 0 | 0 | 1 | 0 | $A_3=1, A_X=0$ |
| $T_{15}$ | 0 | 0 | 0 | 1 | $A_2=1, A_X=0$ |
| $T_{16}$ | 0 | 0 | 0 | 0 | $A_1=1, A_X=0$ |
| $T_{17}$ | 0 | 0 | 0 | 1 | $A_2=1, A_X=0$ |
| $T_{18}$ | 0 | 0 | 1 | 0 | $A_3=1, A_X=0$ |
| $T_{19}$ | 0 | 0 | 1 | 1 | $A_4=1, A_X=0$ |
| $T_{20}$ | 0 | 1 | 0 | 0 | $A_5=1, A_X=0$ |
| $T_{21}$ | 0 | 1 | 0 | 1 | $A_6=1, A_X=0$ |
| $T_{22}$ | 0 | 1 | 1 | 0 | $A_7=1, A_X=0$ |
| $T_{23}$ | 0 | 1 | 1 | 1 | $A_8=1, A_X=0$ |
| $T_{24}$ | 1 | 0 | 0 | 0 | $A_9=1, A_X=0$ |
| $T_{25}$ | 1 | 0 | 0 | 1 | $A_{10}=1, A_X=0$ |
| $T_{26}$ | 1 | 0 | 1 | 0 | $A_{11}=1, A_X=0$ |
| $T_{27}$ | 1 | 0 | 1 | 1 | $A_{12}=1, A_X=0$ |
| $T_{28}$ | 1 | 1 | 0 | 0 | $A_{13}=1, A_X=0$ |
| $T_{29}$ | 1 | 1 | 0 | 1 | $A_{14}=1, A_X=0$ |
| $T_{30}$ | 1 | 1 | 1 | 0 | $A_{15}=1, A_X=0$ |
| $T_{31}$ | 1 | 1 | 1 | 1 | $A_{16}=1, A_X=0$ |

As described above, the ink-jet chip of the present invention achieves the objects of controlling the largest number of ink-jet elements with the lowest number of control contacts, for reducing the manufacturing cost and the volume of the ink-jet chip, and further reducing the volume of the ink-jet cartridge, by means of making the counter of the ink-jet signal to generate circuit thereof generating a plurality of counter signals corresponding to the counter control signals and the pulse signals it received, and making the decoder to decode the plurality of counter signals for generating a plurality of address signals. As a result, the ink-jet chip of the present invention already has the industrial applicability as required by the patent law.

Although the present invention has been explained in relation to its preferred embodiment, it is to be understood that many other possible modifications and variations can be made without departing from the spirit and scope of the invention as hereinafter claimed.

What is claimed is:

1. An ink jet chip, adaptive for a printing device, at least comprising:

a plurality of ink-jet heating elements; and an ink-jet signal generating circuit, at least including:

a counter electrically connected with the printing device, for receiving a counter control signal, having a first counter control signal and a second counter control signal, and a pulse signal outputted from the printing device, and generating a plurality of counter signals corresponding to the counter control signal and the pulse signal; and a decoder electrically connected with the counter, for receiving and decoding the plurality of counter signals, for generating a plurality of address signals, and selecting a corresponding ink-jet heating element basing on the plurality of address signals, wherein the counter is an up/down counting counter, having both functions of counting up and counting down, and the counter switches to the function of counting up when the first counter control signal is in an enabled status and the second counter control signal is in a disabled status, and switches to the function of counting down when the first counter control signal is in a disabled status and the second counter control signal is in an enabled status.

2. The ink-jet chip as claimed in claim 1, wherein the counter counts increasingly in the function of counting up, and the counter counts decreasingly in the function of counting down.

3. The ink-jet chip as claimed in claim 1, wherein the counter comprises JK flip-flop, D flip-flop, T flip-flop, RS flip-flop, or the group consisting thereof.

4. The ink-jet chip as claimed in claim 3, wherein the counter further comprises AND gate, OR gate, NOT gate, NAND gate, NOR gate, XOR gate, XNOR gate, or the group consisting thereof.

5. The ink-jet chip as claimed in claim 1, wherein the decoder comprises AND gate, OR gate, NOT gate, NAND gate, NOR gate, XOR gate, XNOR gate, or the group consisting thereof.

* * * * *